US009050515B1

(12) United States Patent
Kimura

(10) Patent No.: US 9,050,515 B1
(45) Date of Patent: Jun. 9, 2015

(54) GOLF SWING TRAINING MACHINE

(76) Inventor: Calvin M. Kimura, Sun City Center, FL (US)

( * ) Notice: Subject to any disclaimer, the term of this patent is extended or adjusted under 35 U.S.C. 154(b) by 679 days.

(21) Appl. No.: 13/399,311

(22) Filed: Feb. 17, 2012

(51) Int. Cl.
*A63B 69/36* (2006.01)
*A63B 69/00* (2006.01)

(52) U.S. Cl.
CPC ..... *A63B 69/0057* (2013.01)

(58) Field of Classification Search
CPC ..... A63B 69/005; A62B 69/3627
USPC ..... 473/215, 216, 257, 264, 266, 267, 271, 473/272, 277
See application file for complete search history.

(56) References Cited

U.S. PATENT DOCUMENTS

| | | | | | |
|---|---|---|---|---|---|
| 2,469,301 | A | * | 5/1949 | Johnston | 473/277 |
| 3,079,152 | A | * | 2/1963 | Cushing | 473/277 |
| 3,623,733 | A | * | 11/1971 | Cavanaugh | 473/265 |
| 3,698,721 | A | * | 10/1972 | Stewart | 473/264 |
| 4,061,340 | A | | 12/1977 | Husted | |
| 4,273,336 | A | | 6/1981 | Larkey | |
| 4,462,599 | A | * | 7/1984 | Brown | 473/430 |
| 5,050,885 | A | | 9/1991 | Ballard et al. | |
| 5,102,142 | A | * | 4/1992 | Bittl | 473/276 |
| 5,203,569 | A | * | 4/1993 | Rilling | 473/277 |
| 5,294,126 | A | | 3/1994 | Armstrong, III | |
| 5,449,335 | A | * | 9/1995 | Steinfeld | 482/110 |
| 5,560,604 | A | | 10/1996 | Watts | |
| 5,957,789 | A | * | 9/1999 | Ainscough et al. | 473/423 |
| D417,251 | S | | 11/1999 | Francisco | |
| 6,120,386 | A | | 9/2000 | Hill | |
| 6,364,786 | B1 | | 4/2002 | Khano | |
| 6,575,844 | B1 | * | 6/2003 | Gray | 473/277 |
| 7,118,489 | B1 | | 10/2006 | Hubley | |
| 7,214,139 | B2 | | 5/2007 | Parris et al. | |
| 2002/0025892 | A1 | | 2/2002 | Chapman et al. | |
| 2003/0096659 | A1 | * | 5/2003 | Webb | 473/174 |
| 2007/0167250 | A1 | | 7/2007 | Dean | |
| 2007/0251955 | A1 | * | 11/2007 | Green | 222/185.1 |
| 2008/0274821 | A1 | | 11/2008 | Mazzone | |

* cited by examiner

*Primary Examiner* — Nini Legesse
(74) *Attorney, Agent, or Firm* — Richard L. Miller

(57) ABSTRACT

A device training muscles of a golfer to remember how to properly swing a golf club through a set-up position, a turning position without swaying to hit a golf ball, and a follow through position. The device includes a base, an upright portion, and a lateral portion. The base rests on a generally horizontal surface, adjacent to the golfer. The upright portion extends generally vertically upwardly from the base, adjacent to the golfer. The lateral portion extends generally horizontally outwardly from the upright portion, and partially encircles the golfer to train the muscles of the golfer to remember how to properly swing the golf club through the set-up position, the turning position without swaying to hit the golf ball, and the follow-through position.

36 Claims, 11 Drawing Sheets

GOLF SWING TRAINING MACHINE

1. BACKGROUND OF THE INVENTION

A. Field of the Invention

The embodiments of the present invention relate to a device for training a golfer to swing a golf club to hit a golf ball, and more particularly, the embodiments of the present invention relate to a device for training muscles of a golfer to remember how to properly swing a golf club through a set-up position, a turning position without swaying to hit a golf ball, and a follow through position.

B. Description of the Prior Art

Numerous innovations for golf swing aids have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention in that they do not teach a device for training muscles of a golfer to remember how to properly swing a golf club through a set-up position, a turning position without swaying to hit a golf ball, and a follow through position.

(1) U.S. Pat. No. 4,061,340 to Husted.

U.S. Pat. No. 4,061,340—issued to Husted on Dec. 6, 1977 in U.S. class 473 and subclass 212—teaches a golf swing aid for controlling the position of the swing arm of the golfer. The aid includes a removable belt surrounding the body of the golfer attached to a plastic horseshoe-type member. The swing arm of the golfer is contained within the horseshoe member so that the arm cannot extend laterally from the body.

(2) U.S. Pat. No. 4,273,336 to Larkey.

U.S. Pat. No. 4,273,336—issued to Larkey on Jun. 16, 1981 in U.S. class 473 and subclass 213—teaches a golf swing aid that fits around the wrists of a golfer and assists in keeping the golfer's wrists together during a golf swing. The golf swing aid includes a first wrist strap having cooperating fasteners at opposite ends for releasably securing it around a golfer's wrist. An elastically stretchable second wrist strap overlies the first strap, and its opposite ends are secured to the first strap to form an elastically stretchable loop that faces the golfer's other wrist. The second strap can be stretched to loop around the golfer's other wrist when the golfer grips a golf club. The second strap, when looped around the golfer's other wrist, stays under tension to provide an elastic return force that resists any tendency of the golfer to separate his wrists during a golf swing.

(3) U.S. Pat. No. 5,050,885 to Ballard et al.

U.S. Pat. No. 5,050,885—issued to Ballard et al. on Sep. 24, 1991 in U.S. class 473 and subclass 216—teaches a golf swing training apparatus having a saddle for attachment to the hips of a golfer, a first assembly to guide the saddle laterally during the golf swing, a second assembly to promote opposite hip rotations during the golfer's backswing and follow-through, respectively, and a third assembly to position the golfer's shoulders throughout the swing. The first assembly includes a traveler mounted to move laterally on a straight track that is rotatably mounted on a pivotable connecting assembly that is supported by a base. The second assembly is a spring and hinge assembly having a first hinge around which the saddle rotates during the backswing, and a second hinge around which the saddle rotates during the follow-through. The third assembly includes a vest worn by the golfer, a rigid back plate, a vertically extensible support assembly rotatably mounted on the saddle, and tension apparatus that applies rotational force to the support assembly during the backswing. A leg movement limiting device is attached to the base or positioned on the surface on which the golfer stands to limit the golfer's leg movement during the golf swing.

(4) U.S. Pat. No. 5,294,126 to Armstrong, I I I.

U.S. Pat. No. 5,294,126—issued to Armstrong, I I I on Mar. 15, 1994 in U.S. class 473 and subclass 227—teaches a golf swing aid that includes a shaft with a grooved undersurface for engagement to a golf club, and an extending tab to indicate to the golfer the proper cocking and uncocking of his wrists during a golf swing. The golf swing aid has at opposite end curved portions shaped to allow the golfer to pass his arms through and restrict his arms within for putting practice. Additionally, the extending tab has an associated arrow that is used with a ruler to aid the golfer in putting straight.

(5) U.S. Pat. No. 5,560,604 to Watts.

U.S. Pat. No. 5,560,604—issued to Watts on Oct. 1, 1996 in U.S. class 473 and subclass 147—teaches a golf swing aid apparatus that includes a pair of posts having holes proximate to their upper ends. The pair of posts are transversely spaced and adapted to be secured to a ground surface. A relatively short extensible elastomeric shock cord is joined at its ends to the upper ends of respective pair of posts, at the holes. The shock cord is held taut by an adjustable tension apparatus that includes eye bolts that extend transversely in line with the shock cord from the respective holes in the posts. Adjustment apparatus adjusts the extent to which the eye bolts extend from the posts to adjust the tension in the shock cord. A ring has a control opening substantially larger than the diameter of the shock cord and surrounds the shock cord to be freely slidable along it. A golf ball has an aperture extending through it. An inextensible cord that is of relatively greater length than the elastomeric shock cord. The inextensible cord has a loop at each end. One loop passes through the golf ball aperture, and the other loop passes through the ring, whereby a golfer can identify and correct a slicing or hooking stroke and retrieve the golf ball without a hazardous return.

(6) U.S. Pat. No. Des. 417,251 to Francisco.

U.S. Pat. No. Des. 417,251—issued to Francisco on Nov. 30, 1999 in U.S. class D21 and subclass 791—teaches the ornamental design for a golf swing aid.

(7) U.S. Pat. No. 6,120,386 to Hill.

U.S. Pat. No. 6,120,386—issued to Hill on Sep. 19, 2000 in U.S. class 473 and subclass 277—teaches a golf swing training device for developing the memory of a proper golf swing for every golf club a golfer uses in their game so that each swing is naturally and consistently repeated when they engage in actual play. The golf swing training device includes a base for receiving a golfer's front foot, at least one pivot arm having a first end pivotally mounted to the base and a second end opposite the first end, a biasing mechanism for biasing the pivot arm to a first position with respect to vertical, and an engagement member disposed on the second end of the pivot arm for engaging the golfer's hip area when they position their front foot on the base to address the golf ball. Engagement of the engagement member displaces the pivot arm to a second position with respect to vertical and creates a constant pressure force against the golfer's hip area, which ingrains the golfer's mind with the memory of the proper pace and body position for performing each golf swing. The biasing mechanism automatically resets the golf swing training device to optimize repetition of the swing process and development of the swing memory. The golf swing trainer trains the golfer's swing memory for the full range of golf clubs used in a golfer's game including driving, chipping, and putting.

(8) United States Patent Application Publication Number 2002/0025892 to Chapman et al.

United States Patent Application Publication Number 2002/0025892—published to Chapman et al. on Feb. 28, 2002 in U.S. class 482 and subclass 135—teaches a piece of exercise equipment designed to train and condition sport-specific muscle groups used during a swinging motion, as in golf. It includes a mechanical linkage with at least six degrees of freedom of motion so that it effectively simulates a wide variety of golf swings without the need for complex adjustments. It includes a resistance mechanism, such as a pulley system, linked to two one-way hydraulic cylinders. This allows a user to simultaneously practice swing form and technique, while also strengthening and conditioning the specific muscles needed for the sport.

(9) U.S. Pat. No. 6,364,786 to Khano.

U.S. Pat. No. 6,364,786—issued to Khano on Apr. 2, 2002 in U.S. class 473 and subclass 257—teaches a golf swing teaching device to assist a golfer in improving his or her golf swing. The teaching device includes a frame that supports a guide shaft that is formed in the shape of an arc. A golf club is affixed at its butt end to the guide shaft. It is affixed to the guide shaft so that it may slide along the guide shaft. In this way, the golfer may swing the club and be assisted to move the butt end of the golf club in an arcuate path.

(10) U.S. Pat. No. 7,118,489 to Hubley.

U.S. Pat. No. 7,118,489—issued to Hubley on Oct. 10, 2006 in U.S. class 473 and subclass 226—teaches an apparatus for a golf swing training device. The apparatus includes golf club having a shaft with a grip at one end, and a club head at the other end of the shaft having a cup attached to the face of the club head, with the cup opening on the front towards the intended target. The bore of the cup conforms substantially to the diameter of the ball. In use, a ball is placed in the cup with the intention of releasing the ball from the cup at a desired point during the swing at a target. In practice, if during the back swing, the cup is incorrectly tilted due to poor swing mechanics the ball will fall out. Also, if the bore of the cup is not in alignment with the target line at the ball's point of release, the ball trajectory will be skewed from the target. As an additional element, the cup can have a circumferential ridge on the interior to impede the ball from easily falling out, and the cup can be removably attached to the club face.

(11) U.S. Pat. No. 7,214,139 to Parris et al.

U.S. Pat. No. 7,214,139—issued to Parris et al. on May 8, 2007 in U.S. class 473 and subclass 212—teaches a method and system for indicating to a user when the user has performed an improper golf swing, including a positioning portion, and an indicating portion coupled to the positioning portion. The indicating portion is selectively positional via the positioning portion, adjacent a user to provide an indication when the user performs an improper swing.

(12) United States Patent Application Publication Number 2007/0167250 to Dean.

United States Patent Application Publication Number 2007/0167250 published to Dean on Jul. 19, 2007 in U.S. class 473 and subclass 278 teaches a standing platform to be used by a golfer to practice swinging a golf club. The standing platform element is covered with carpet upon which a golfer can stand comfortably.

(13) United States Patent Application Publication Number 2008/0274821 to Mazzone.

United States Patent Application Publication Number 2008/0274821 published to Mazzone on Nov. 6, 2008 in U.S. class 473 and subclass 277 teaches a golf swing aid that includes a base, an elongated member, and at least one generally L-shaped member. The one or more generally L-shaped members are moveably connected to the elongated member so that the one or more generally L-shaped members are positionable vertically along at least a portion of the length of the elongated member and horizontally in a direction substantially transverse to the length of the elongated member. In certain embodiments, the generally L-shaped members may be removably connected to the elongated member.

It is apparent that numerous innovations for golf swing aids have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a device for training muscles of a golfer to remember how to properly swing a golf club through a set-up position, a turning position without swaying to hit a golf ball, and a follow through position.

2. SUMMARY OF THE INVENTION

Thus, an object of the embodiments of the present invention is to provide device for training muscles of a golfer to remember how to properly swing a golf club through a set-up position, a turning position without swaying to hit a golf ball, and a follow through position, which avoids the disadvantages of the prior art.

Briefly stated, another object of the embodiments of the present invention is to provide a device training muscles of a golfer to remember how to properly swing a golf club through a set-up position, a turning position without swaying to hit a golf ball, and a follow through position. The device includes a base, an upright portion, and a lateral portion. The base rests on a generally horizontal surface, adjacent to the golfer. The upright portion extends generally vertically upwardly from the base, adjacent to the golfer. The lateral portion extends generally horizontally outwardly from the upright portion, and partially encircles the golfer to train the muscles of the golfer to remember how to properly swing the golf club through the set-up position, the turning position without swaying to hit the golf ball, and the follow-through position.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

4. LIST OF REFERENCE NUMERALS UTILIZED IN THE FIGURES OF THE DRAWING

A. Introductory

Figure 1:
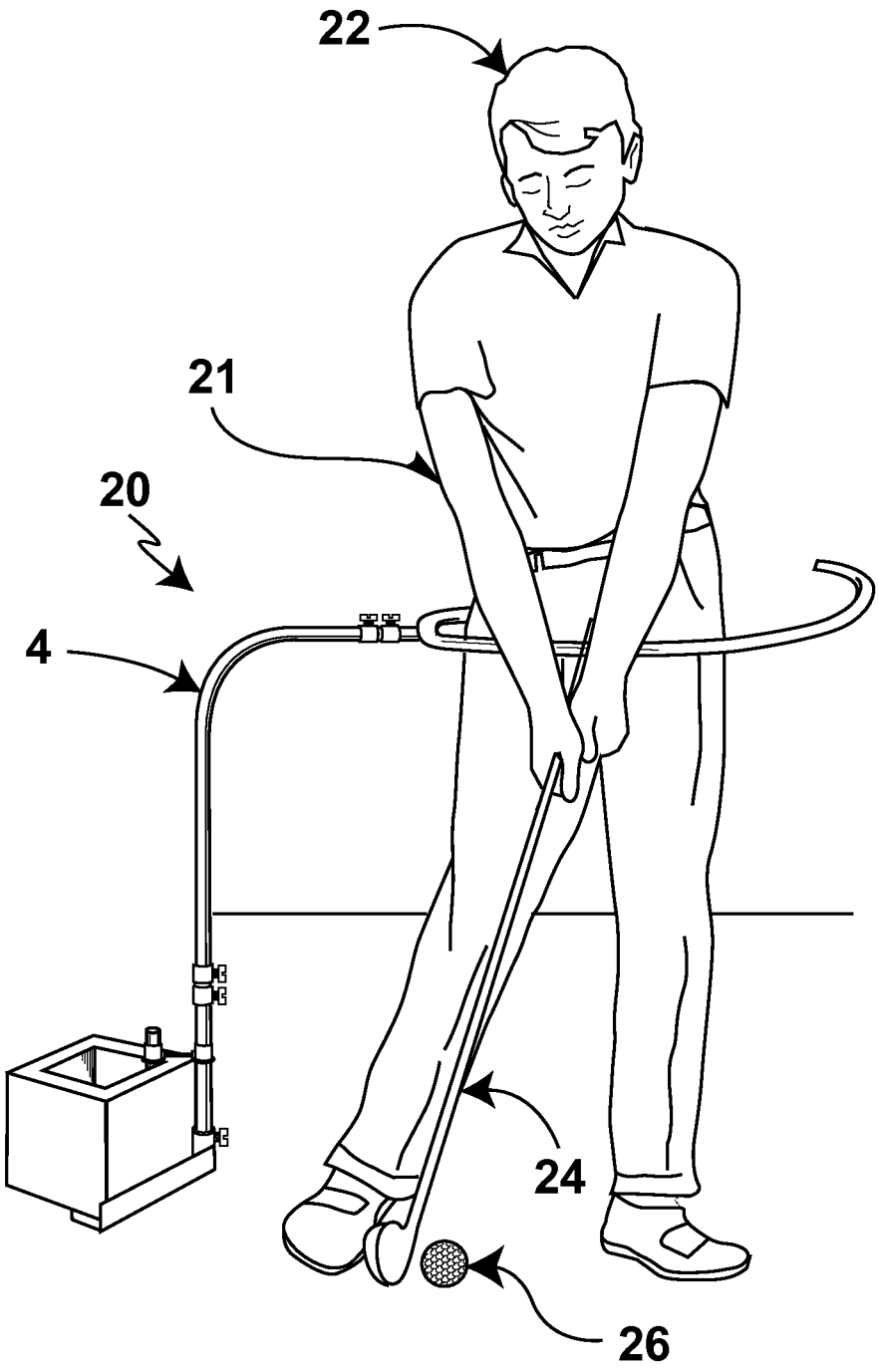
FIG. 1 is a diagrammatic perspective view of the device of the embodiments of the present invention training muscles of a golfer to remember how to properly swing a golf club through a set-up position, a turning position without swaying to hit a golf ball, and a follow through position, with the golfer in the set-up position.

20 device of embodiments of present invention for training muscles 21 of golfer 22 to remember how to properly swing golf club 24 through set-up position, turning position without swaying to hit golf ball 26, and follow through position
21 muscles of golfer 22
22 golfer
24 golf club
26 golf ball

B. Overall Configuration of Device 20

28 base for resting on generally horizontal surface 34, adjacent to golfer 22
30 upright portion for being adjacent to golfer 22
32 lateral portion for partially encircling golfer 22 for training muscles 21 of golfer 22 to remember how to properly swing golf club 24 through set-up position, turning position without swaying to hit golf ball 26, and follow-through position
34 generally horizontal surface

C. Specific Configuration of Base 28

36 base plate of base 28 for resting on generally horizontal surface 34, adjacent to golfer 22
38 plate of base plate 36 of base 28 for resting on generally horizontal surface 34, adjacent to golfer 22
40 wall of base plate 36 of base 28
42 pair of equal sides of plate 38 of base plate 36 of base 28
44 apex of plate 38 of base plate 36 of base 28
46 first cup of base 28
48 second cup of base 28
50 tube of base 28
52 anchoring bolt of base 28
54 cinder block of base 28
56 hollow core of cinder block 54 of base 28
58 inside corner of hollow core 58 of cinder block 54 of base 28

D. Specific Configuration of Upright Portion 30

60 base tube of upright portion 30
62 coupling of upright portion 30
63 pair of anchoring bolts of coupling 62 of upright portion 30
64 variety of different sized tubes of upright portion 30 for adjusting device 20 to different heights of golfers 22
66 connector of upright portion 30

E. Specific Configuration of Lateral Portion 32

68 confining member of lateral portion 32 for allowing golfer 22 to enter therein and be partially encircled thereby for training muscles 21 of golfer 22 to remember how to properly swing golf club 24 through set-up position, turning position without swaying to hit golf ball 26, and follow-through position
70 neck of lateral portion 32
72 extension of highest one of variety of different sized tubes 64 of upright portion 30

F. Specific Configuration of First Alternate Embodiment of Base 128

128 base
152 anchoring bolt of base 128
174 hub of base 128
176 rim of base 128
178 spokes of base 128
180 cup of hub 174 of base 128

G. Specific Configuration of Second Alternate Embodiment of Base 228

228 base
252 anchoring bolt of base 228
280 cup of base 228
282 hollow disc of base 228
284 weighted material of hollow disc 282 of base 228
286 fill neck of base 228
288 cap of base 228

5. DETAILED DESCRIPTION OF THE PREFERRED EMBODIMENTS

A. Introductory

Figure 2:
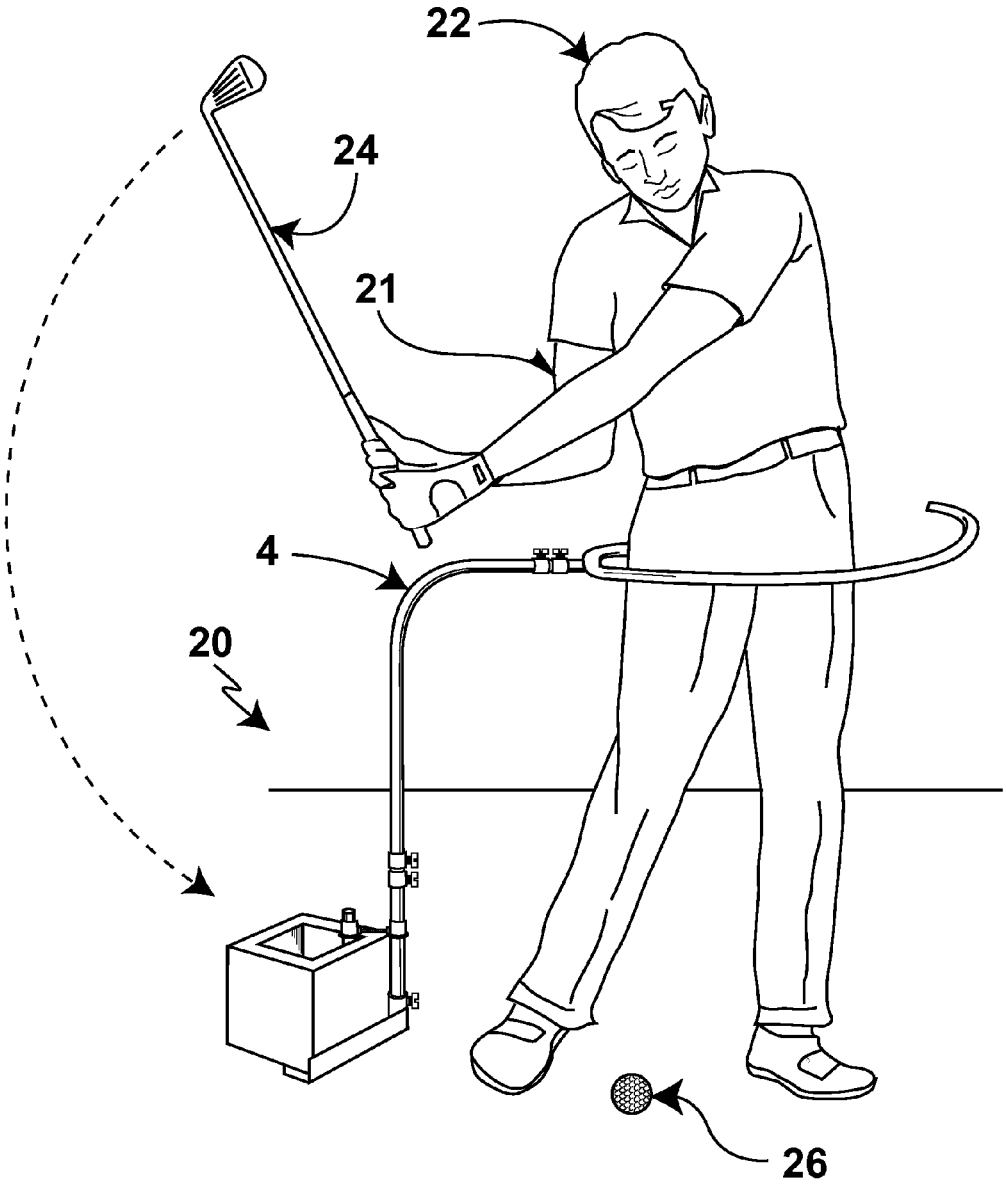
FIG. 2 is a diagrammatic perspective view of the device of the embodiments of the present invention training muscles of a golfer to remember how to properly swing a golf club through a set-up position, a turning position without swaying to hit a golf ball, and a follow through position, with the golfer in the turning position.
Figure 3:
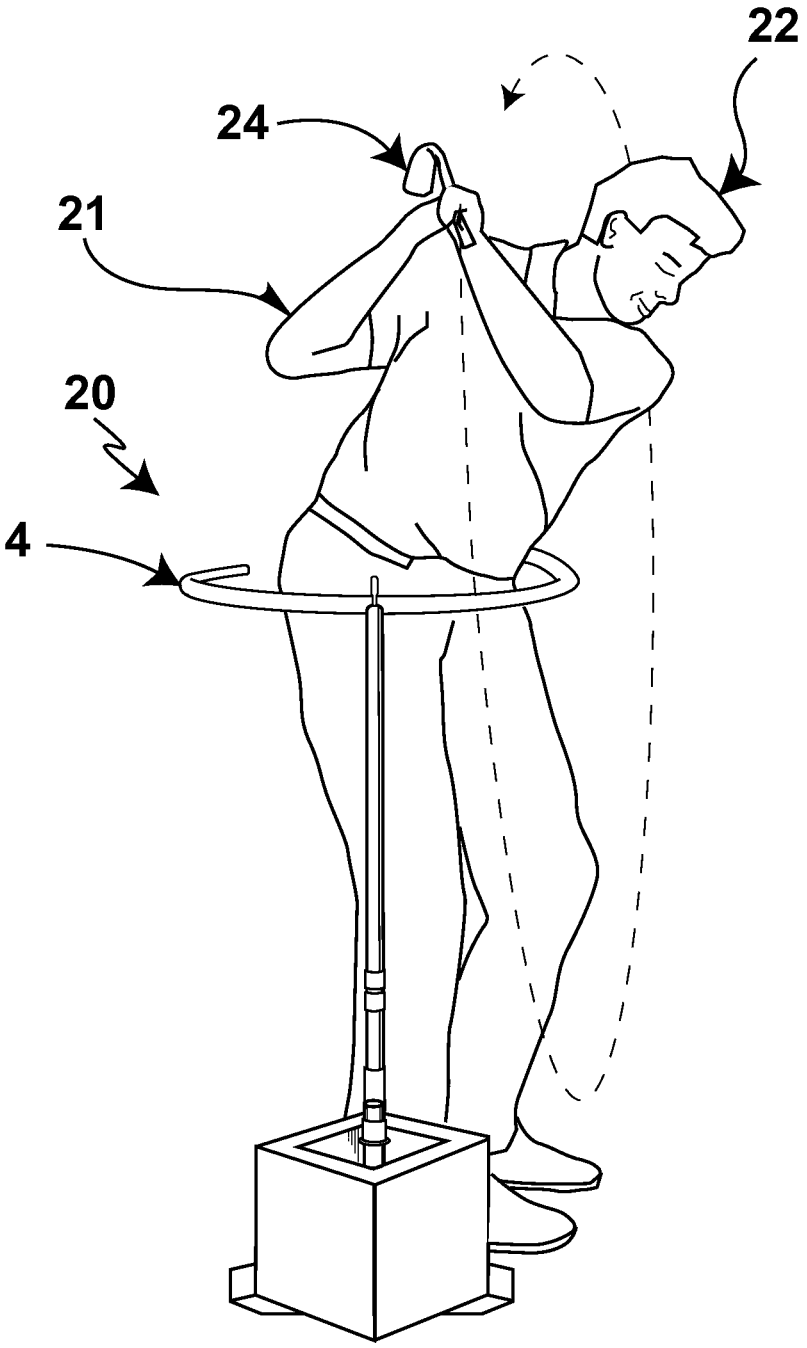
FIG. 3 is a diagrammatic perspective view of the device of the embodiments of the present invention training muscles of a golfer to remember how to properly swing a golf club through a set-up position, a turning position without swaying to hit a golf ball, and a follow through position, with the golfer in the follow-through position.

Referring now to the figures, in which like numerals indicate like parts, and particularly to FIGS. 1-3, which are, respectively, a diagrammatic perspective view of the device of the embodiments of the present invention training muscles of a golfer to remember how to properly swing a golf club through a set-up position, a turning position without swaying to hit a golf ball, and a follow through position, with the golfer in the set-up position, a diagrammatic perspective view of the device of the embodiments of the present invention training muscles of a golfer to remember how to properly swing a golf club through a set-up position, a turning position without swaying to hit a golf ball, and a follow through position, with the golfer in the turning position, and a diagrammatic perspective view of the device of the embodiments of the present invention training muscles of a golfer to remember how to properly swing a golf club through a set-up position, a turning position without swaying to hit a golf ball, and a follow through position, with the golfer in the follow-through position, the device of the embodiments of the present invention is shown generally at 20 for training muscles 21 of a golfer 22 to remember how to properly swing a golf club 24 through a set-up position, a turning position without swaying to hit a golf ball 26, and a follow through position.

B. Overall Configuration of the Device 20

The overall configuration of the device 20 can best be seen in FIGS. 4 and 5, which are, respectively, a diagrammatic perspective view of the device of the embodiments of the present invention identified by ARROW 4 in FIGS. 1-3, and a diagrammatic top plan view taken generally in the direction of ARROW 5 in FIG. 4, and as such, will be discussed with reference thereto.

The device 20 comprises a base 28, an upright portion 30, and a lateral portion 32. The base 28 is for resting on a generally horizontal surface 34, adjacent to the golfer 22. The upright portion 30 extends generally vertically upwardly from the base 28, and is for being adjacent to the golfer 22. The lateral portion 32 extends generally horizontally outwardly from the upright portion 30, and is for partially encircling the golfer 22 for training the muscles 21 of the golfer 22 to remember how to properly swing the golf club 24 through the set-up position, the turning position without swaying to hit the golf ball 26, and the follow-through position.

C. Specific Configuration of the Base 28

Figure 4:
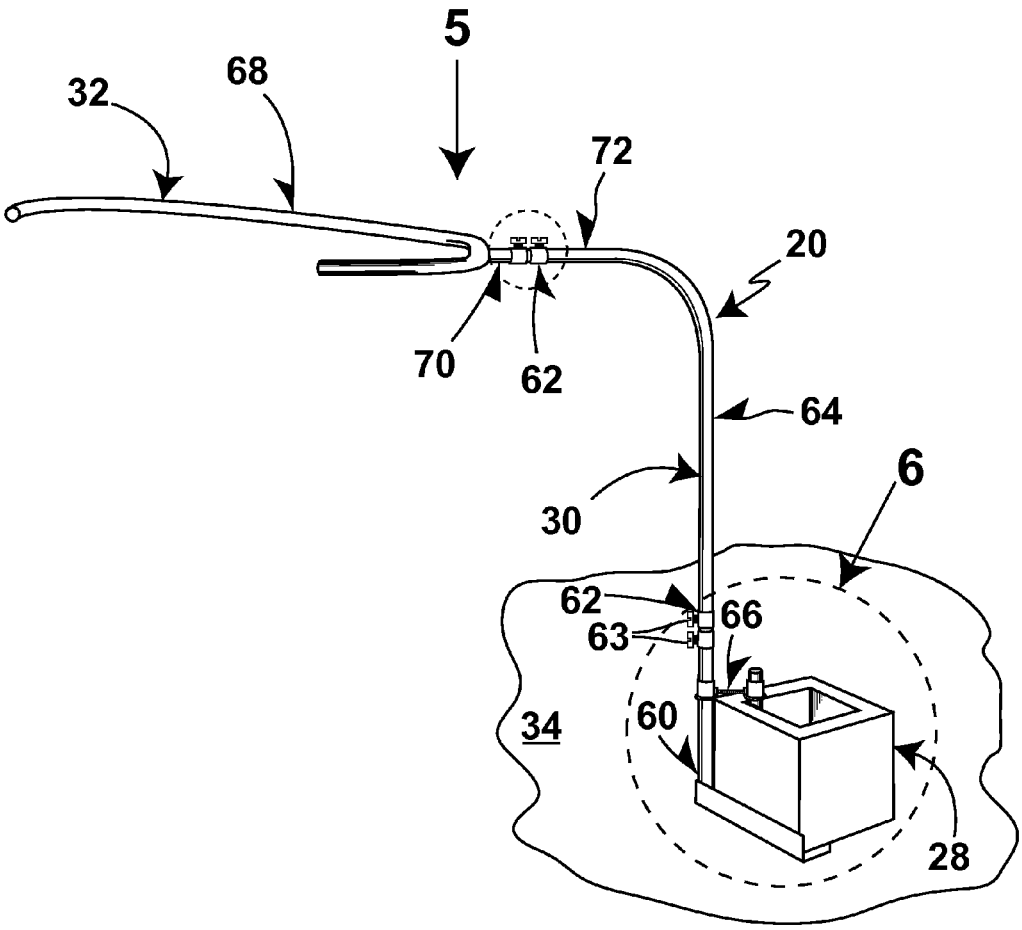
FIG. 4 is a diagrammatic perspective view of the device of the embodiments of the present invention identified by ARROW 4 in FIGS. 1-3.
Figure 5:
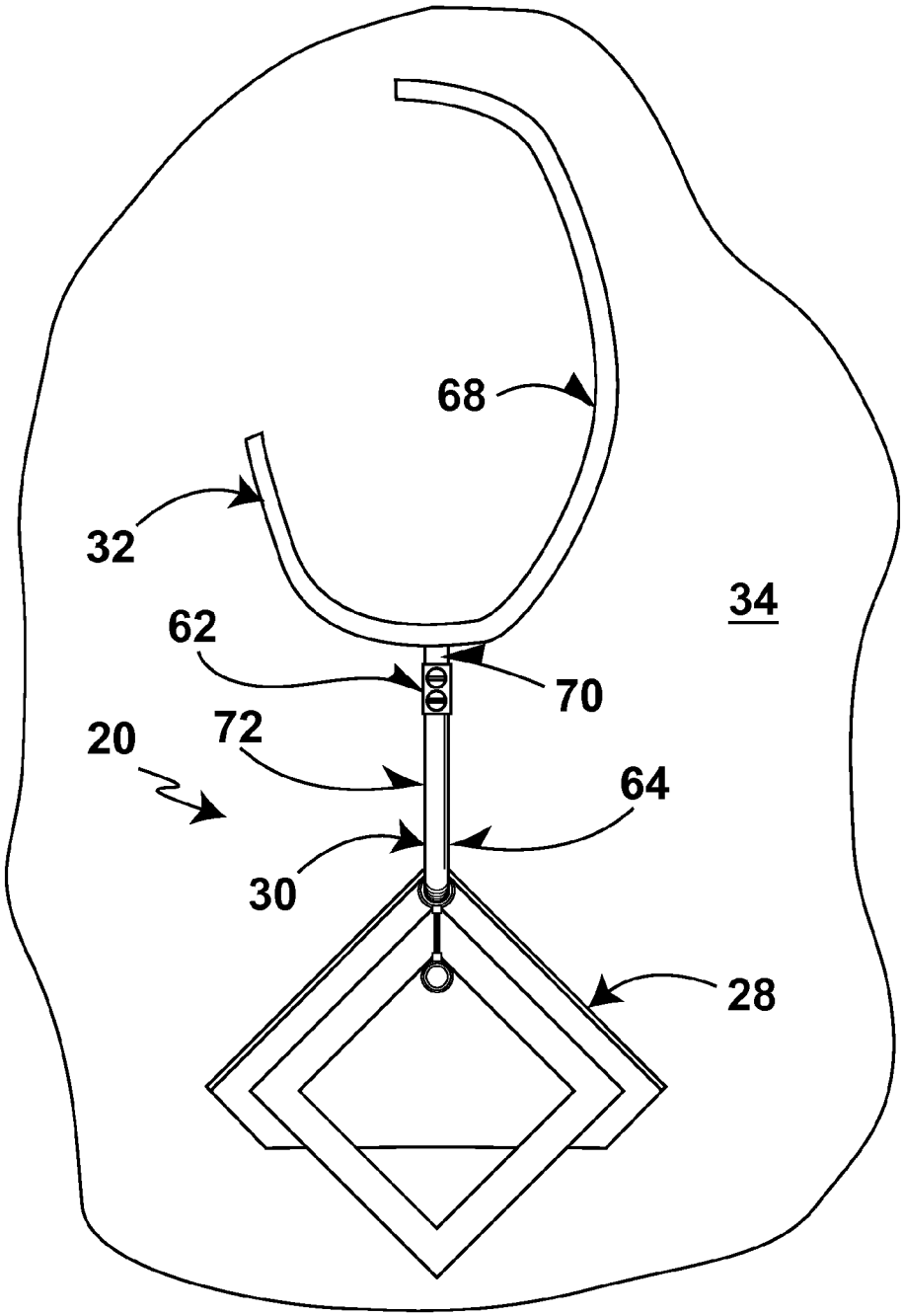
FIG. 5 is a diagrammatic top plan view taken generally in the direction of ARROW 5 in FIG. 4.
Figure 6:
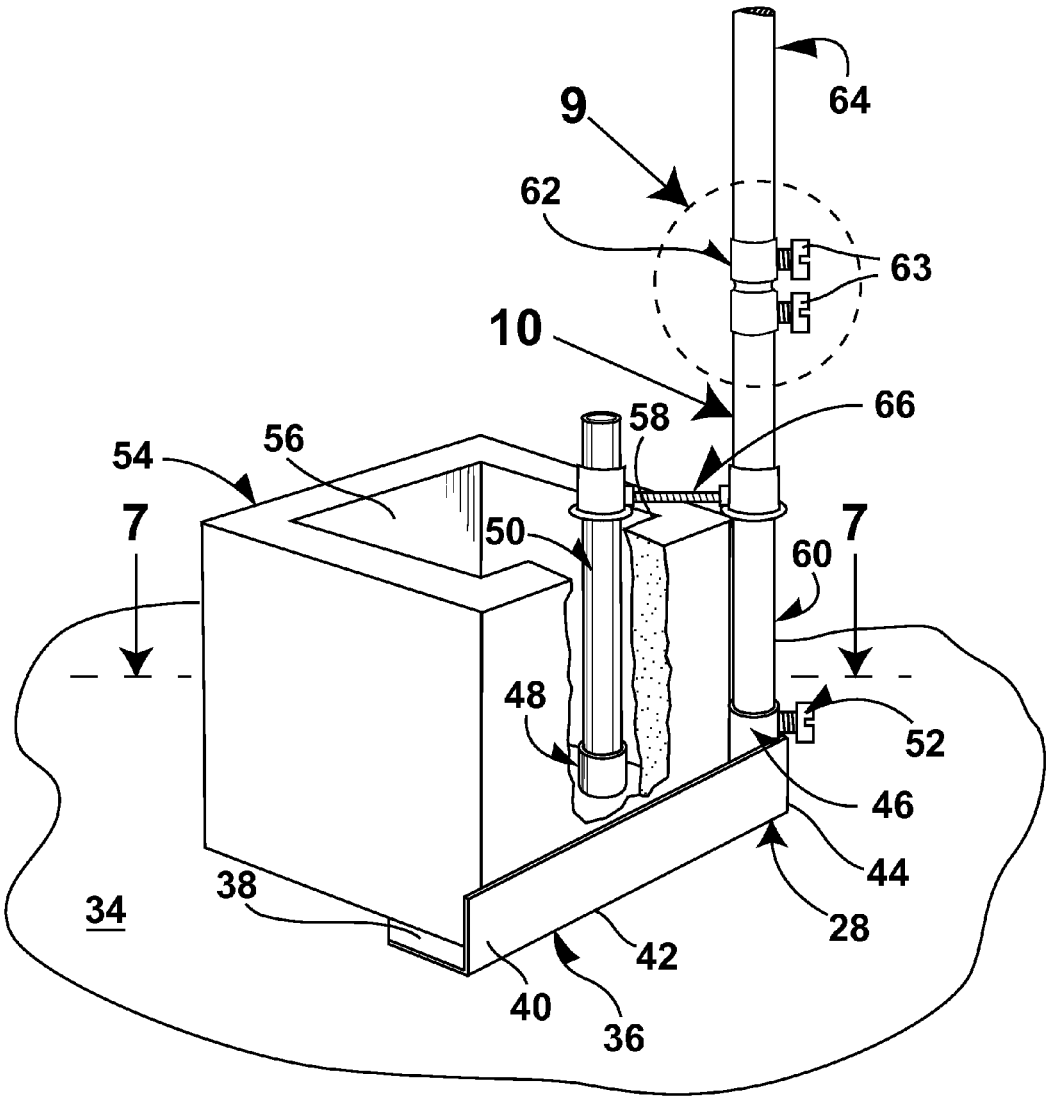
FIG. 6 is an enlarged diagrammatic perspective view of the area generally enclosed by the dotted curve identified by ARROW 6 in FIG. 4 of the base of the device of the embodiments of the present invention.
Figure 7:
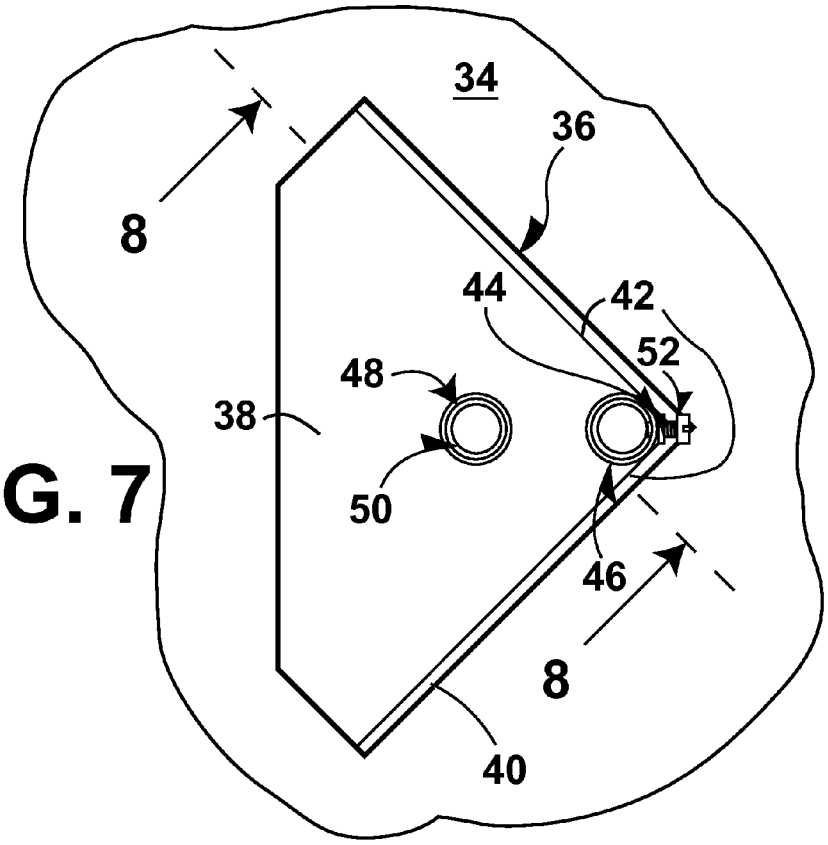
FIG. 7 is an enlarged diagrammatic top plan view taken generally in the direction of ARROWS 7 in FIG. 6 of the base of the device of the embodiments of the present invention.
Figure 8:
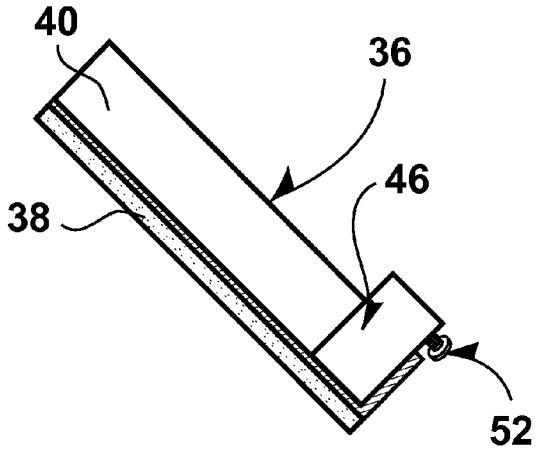
FIG. 8 is a diagrammatic cross sectional view taken along LINE 8-8 in FIG. 7.

The specific configuration of the base 28 can best be seen in FIGS. 6-8, which are, respectively, an enlarged diagrammatic perspective view of the area generally enclosed by the dotted curve identified by ARROW 6 in FIG. 4 of the base of the device of the embodiments of the present invention, an enlarged diagrammatic top plan view taken generally in the direction of ARROWS 7 in FIG. 6 of the base of the device of the embodiments of the present invention, and a diagrammatic cross sectional view taken along LINE 8-8 in FIG. 7, and as such, will be discussed with reference thereto.

The base 28 comprises a base plate 36. The base plate 36 of the base 28 is for resting on the generally horizontal surface 34, adjacent to the golfer 22.

The base plate 36 of the base 28 includes a plate 38 and a wall 40. The plate 38 of the base plate 36 of the base 28 is for resting on the generally horizontal surface 34, adjacent to the golfer 22, and is generally isosceles triangular-shaped, and as such, has a pair of equal sides 42 straddling an apex 44.

The wall 40 of the base plate 36 of the base 28 extends vertically upwardly from the pair of equal sides 42 of the plate 38 of the base plate 36 of the base 28.

The base 28 further comprises a first cup 46. The first cup 46 of the base 28 extends vertically upwardly from the apex 44 of the plate 38 of the base plate 36 of the base 28.

The base 28 further comprises a second cup 48. The second cup 48 of the base 28 extends vertically upwardly from inwardly of the apex 44 of the plate 38 of the base plate 36 of the base 28.

The base 28 further comprises a tube 50. The tube 50 of the base 28 is replaceably received in, and extends vertically upwardly from, the second cup 48 of the base 28.

The base 28 further comprises an anchoring bolt 52. The anchoring bolt 52 of the base 28 threads laterally into the first cup 46 of the base 28, and selectively affixes the tube 50 of the base 28 into the second cup 48 of the base 28.

The base 28 further comprises a cinder block 54. The cinder block 54 of the base 28 has a hollow core 56 with an inside corner 58, and sits on the plate 38 of the base plate 36 of the base 28, up against the wall 40 of the base plate 36 of the base 28, so as to weigh down the base plate 36 of the base 28, with the tube 50 of the base 28 extending vertically upwardly through the hollow core 56 of the cinder block 54 of the base 28, against the inside corner 58 of the hollow core 56 of the cinder block 54 of the base 28 so as to prevent the cinder block 54 of the base 28 from moving out of position.

D. Specific Configuration of the Upright Portion 30

The specific configuration of the upright portion 30 can best be seen in FIGS. 4, 6, 9, and 10, which are, respectively, again a diagrammatic perspective view of the device of the embodiments of the present invention identified by ARROW 4 in FIGS. 1-3, again an enlarged diagrammatic perspective view of the area generally enclosed by the dotted curve identified by ARROW 6 in FIG. 4 of the base of the device of the embodiments of the present invention, an enlarged diagrammatic side elevational view in partial section of the area generally enclosed by the dotted curve identified by ARROW 9 in FIG. 6 of a coupling of the device of the embodiments of the present invention, and an exploded diagrammatic perspective view of different length portions and couplings of the upright portion of the device of the embodiments of the present invention identified by ARROW 10 in FIG. 6 and allowing accommodations for golfers of different heights, and as such, will be discussed with reference thereto.

The upright portion 30 comprises a base tube 60. The base tube 60 of the upright portion 30 is replaceably received in, and extends vertically upwardly from, the first cup 46 of the base 28 to a coupling 62, and is parallel to the tube 50 of the base 28.

Figure 9:
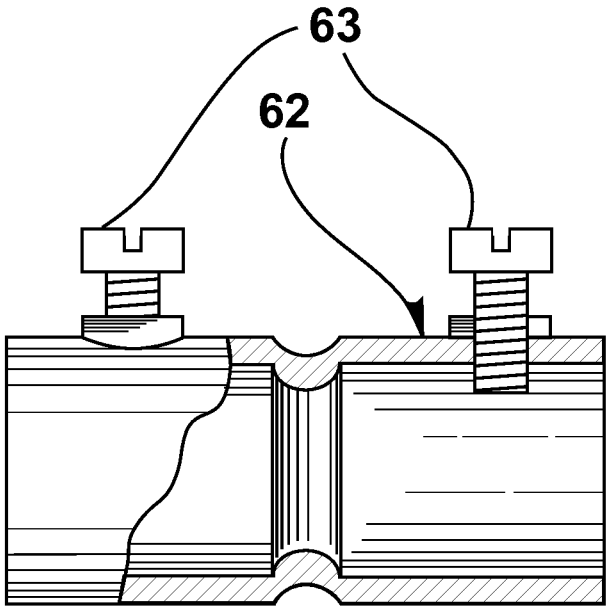
FIG. 9 is an enlarged diagrammatic side elevational view in partial section of the area generally enclosed by the dotted curve identified by ARROW 9 in FIG. 6 of a coupling of the device of the embodiments of the present invention.
Figure 10:
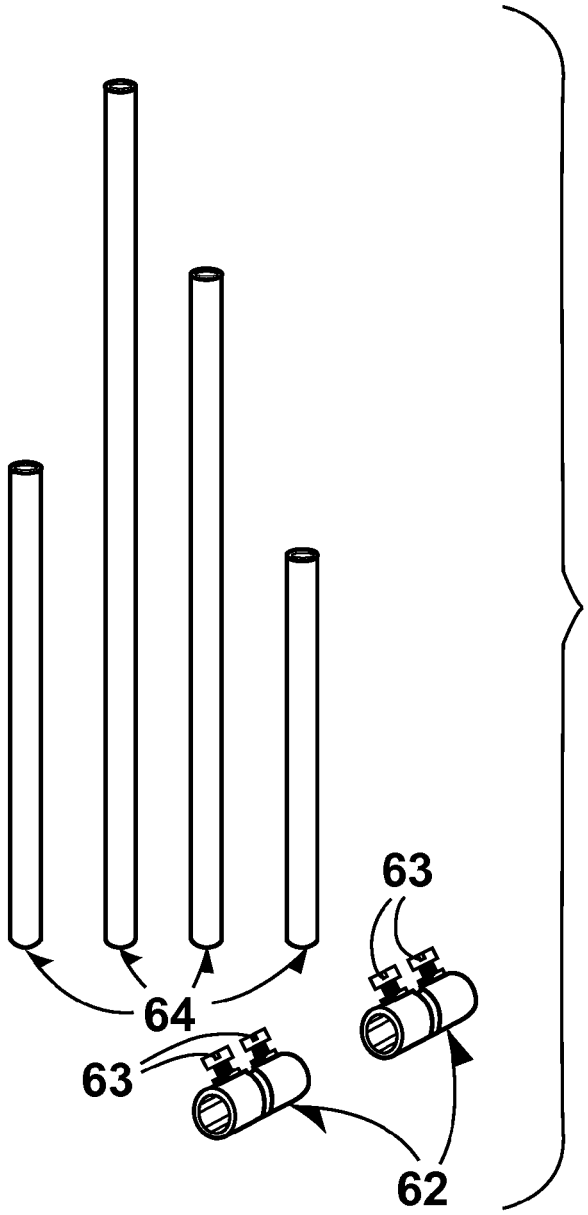
FIG. 10 is an exploded diagrammatic perspective view of different length portions and couplings of the upright portion of the device of the embodiments of the present invention identified by ARROW 10 in FIG. 6 and allowing accommodations for golfers of different heights.

The coupling 62 of the upright portion 30 comprises a pair of anchoring bolts 63. The pair of anchoring bolts 63 of the coupling 62 of the upright portion 30 thread laterally into the coupling 62 of the upright portion 30 (FIG. 9).

The upright portion 30 further comprises a variety of different sized tubes 64. At least one of the variety of different sized tubes 64 of the upright portion 30 is collinearly connected to the coupling 62 of the upright portion 30 for adjusting the device 20 to different heights of golfers 22, and when more than one of the variety of different sized tubes 64 of the upright portion 30 are used, additional couplings 62 connect the more than one of the variety of different sized tubes 64 of the upright portion 30 to each other (FIG. 10, associatively.

The upright portion 30 further comprises a connector 66. The connector 66 of the upright portion 30 connects the base tube 60 of the upright portion 30 to the tube 50 of the base 28 to maintain parallelism therebetween and prevent inadvertent removal of the cinder block 54 of the base 28.

E. Specific Configuration of the Lateral Portion 32

The specific configuration of the lateral portion 32 can best be seen in FIGS. 4 and 5, which are, respectively, again a diagrammatic perspective view of the device of the embodiments of the present invention identified by ARROW 4 in FIGS. 1-3, and again a diagrammatic top plan view taken generally in the direction of ARROW 5 in FIG. 4, and as such, will be discussed with reference thereto.

The lateral portion 32 comprises a confining member 68. The confining member 68 of the lateral portion 32 extends generally horizontally outwardly from the upright portion 30, and is generally C-shaped for allowing the golfer 22 to enter therein and be partially encircled thereby for training the muscles 21 of the golfer 22 to remember how to properly swing the golf club 24 through the set-up position, the turning position without swaying to hit the golf ball 26, and the follow-through position.

The lateral portion 32 further comprises a neck 70. The neck 70 of the lateral portion 32 extends horizontally outwardly from the confining member 68 of the lateral portion 32, towards the upright portion 30.

The lateral portion 32 further comprises an extension 72 of a highest one of the variety of different sized tubes 64 of the upright portion 30 bent normally thereto so as to extend horizontally from the highest one of the variety of different sized tubes 64 of the upright portion 30, and be collinear with the neck 70 of the lateral portion 32.

The extension 72 of the highest one of the variety of different sized tubes 64 of the upright portion 30 is attached to the neck 70 of the lateral portion 32 by another coupling 62.

F. Specific Configuration of a First Alternate Embodiment of the Base 128

Figure 11:
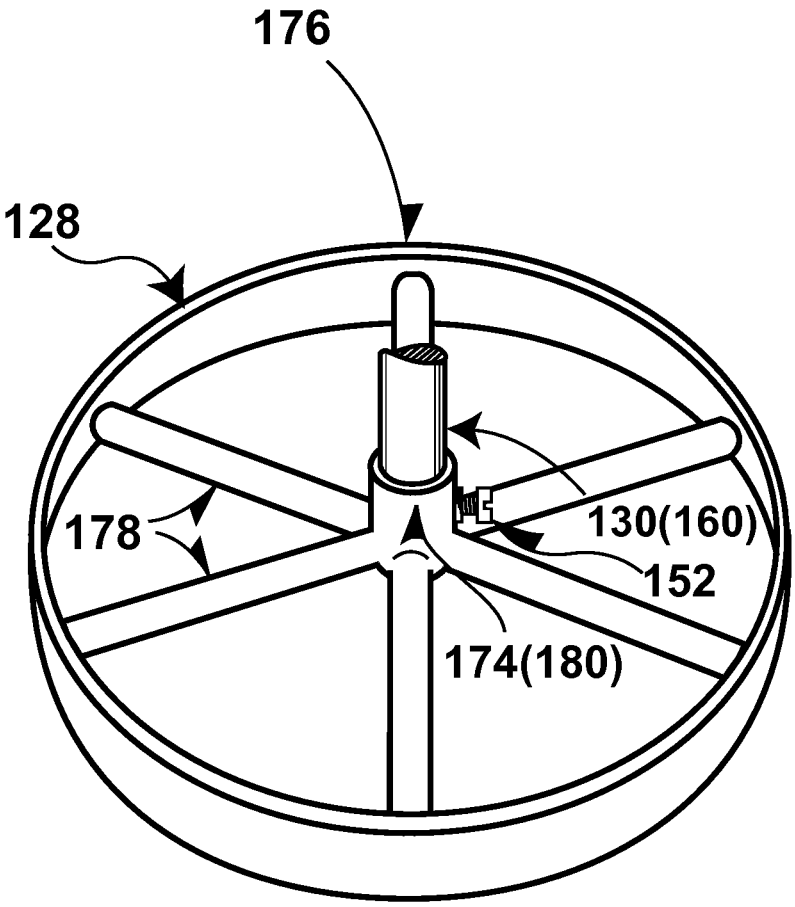
FIG. 11 is a diagrammatic perspective view of a first alternate embodiment of the base of the device of the embodiments of the present invention.

The specific configuration of a first alternate embodiment of the base 128 can best be seen in FIG. 11, which is a diagrammatic perspective view of a first alternate embodiment of the base of the device of the embodiments of the present invention, and as such, will be discussed with reference thereto.

The base 128 is wheel-like, and as such, has a hub 174, a rim 176, and spokes 178 extending radially outwardly from, and connecting, the hub 174 of the base 128 to the rim 176 of the base 128, and is weighted so as to support the upright portion 130.

The hub 174 of the base 128 is a cup 180. The cup 180 of the hub 174 of the base 128 replaceably receives the base tube 160 of the upright portion 130 so as to allow the base tube 160 of the upright portion 130 to extend vertically upwardly therefrom.

The base 128 further comprises an anchoring bolt 152. The anchoring bolt 152 of the base 128 threads laterally into the cup 180 of the hub 174 of the base 128, and selectively affixes the base tube 160 of the upright portion 130 into the cup 180 of the hub 174 of the base 128.

G. Specific Configuration of a Second Alternate Embodiment of the Base 228

Figure 12:
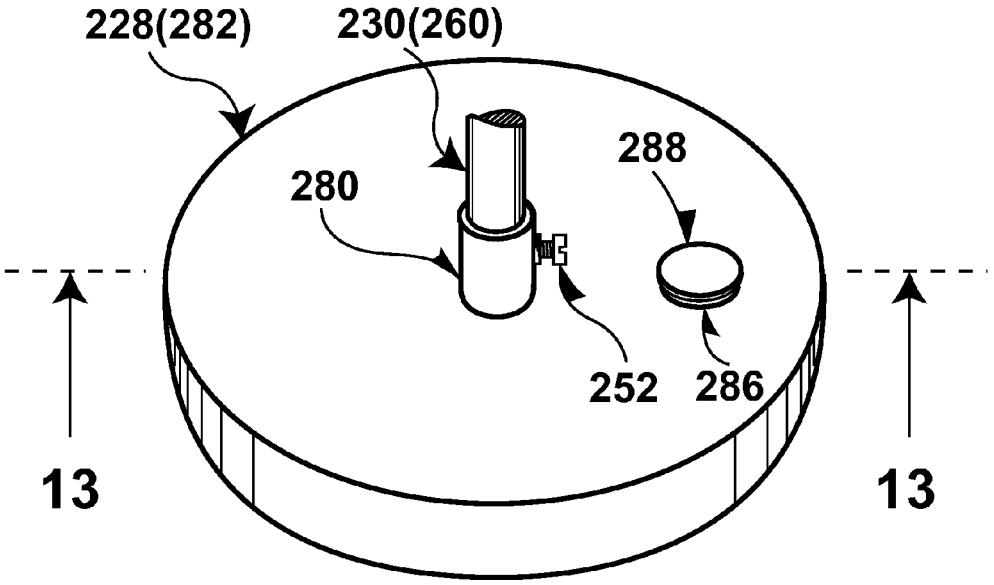
FIG. 12 is a diagrammatic perspective view of a second alternate embodiment of the base of the device of the embodiments of the present invention.
Figure 13:
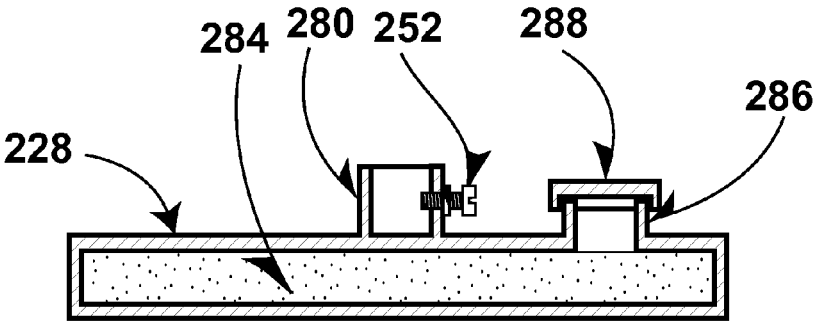
FIG. 13 is a diagrammatic cross sectional view taken along LINE 13-13 in FIG. 12.

The specific configuration of a second alternate embodiment of the base 228 can best be seen in FIGS. 12 and 13, which are, respectively, a diagrammatic perspective view of a second alternate embodiment of the base of the device of the embodiments of the present invention, and a diagrammatic cross sectional view taken along LINE 13-13 in FIG. 12, and as such, will be discussed with reference thereto.

The base 228 comprises a hollow disc 282. The hollow disc 282 of the base 228 is filled with a weighted material 284, for example, sand or water, so as to support the upright portion 230.

The base 228 further comprises a cup 280. The cup 280 of the base 228 is centrally disposed on the hollow disc 282 of the base 228, and replaceably receives the base tube 260 of the upright portion 230 so as to allow the base tube 260 of the upright portion 230 to extend vertically upwardly there from.

The base 228 further comprises an anchoring bolt 252. The anchoring bolt 252 of the base 228 threads laterally into the cup 280 of the base 228, and selectively affixes the base tube 260 of the upright portion 230 into the cup 280 of the base 228.

The base 228 further comprises a filler neck 286. The filler neck 286 of the base 228 communicates with the hollow disc 282 of the base 228 so as to allow the hollow disc 282 of the base 228 to be filled with the weighted material 284 of the hollow disc 282 of the base 228.

The base 228 further comprises a cap 288. The cap 288 of the base 228 selectively closes the filler neck 286 of the base 228 so as to prevent the weighted material 284 of the hollow disc 282 of the base 228 from exiting the disc 282 of the base 228 inadvertently.

H. Impressions

It will be understood that each of the elements described above or two or more together may also find a useful application in other types of constructions differing from the types described above.

While the embodiments of the present invention have been illustrated and described as embodied in a device for training a golfer to properly swing a golf club to hit a golf ball and for not having to directly or indirectly engage any part of the golfer, the golf club, and the golf ball, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A device for training muscles of a golfer to remember how to properly swing a golf club through a set-up position, a turning position without swaying to hit a golf ball, and a follow through position, said device comprising:

a) a base;

b) an upright portion; and c) a lateral portion;

wherein said base is for resting on a generally horizontal surface;

wherein said base is for resting adjacent to the golfer;

wherein said upright portion extends generally vertically upwardly from said base;

wherein said upright portion is for being adjacent to the golfer;

wherein said lateral portion extends generally horizontally outwardly from said upright portion; and wherein said lateral portion is for partially encircling the golfer for training the muscles of the golfer to remember how to properly swing the golf club through the set-up position, the turning position without swaying to hit the golf ball, and the follow-through position;

wherein said base comprises a base plate;

wherein said base plate of said base is for resting on the generally horizontal surface; and wherein said base plate of said base is for resting adjacent to the golfer;

wherein said base plate of said base includes:

a) a plate; and b) a wall;

wherein said plate of said base plate of said base is for resting on the generally horizontal surface; and wherein said plate of said base plate of said base is for resting adjacent to the golfer;

wherein said plate of said base plate of said base is generally isosceles triangular-shaped, and as such, has a pair of equal sides straddling an apex;

wherein said wall of said base plate of said base extends vertically upwardly from said pair of equal sides of said plate of said base plate of said base;

wherein said base comprises a first cup;

wherein said first cup of said base extends vertically upwardly from said apex of said plate of said base plate of said base;

wherein said base comprises a second cup;

wherein said second cup of said base extends vertically upwardly from inwardly of said apex of said plate of said base plate of said base.

2. The device of claim 1, wherein said base comprises a tube.

3. The device of claim 2, wherein said tube of said base is replaceably received in said second cup of said base; and wherein said tube of said base extends vertically upwardly from said second cup of said base.

4. The device of claim 3, wherein said base comprises an anchoring bolt.

5. The device of claim 4, wherein said anchoring bolt of said base threads laterally into said first cup of said base; and wherein said anchoring bolt of said base selectively affixes the upright portion into said first cup of said base.

6. The device of claim 5, wherein said base comprises a cinder block;

wherein said cinder block of said base has a hollow core; and wherein said hollow core of said cinder block of said base has an inside corner.

7. The device of claim 6, wherein said cinder block of said base sits on said plate of said base plate of said base, up against said wall of said base plate of said base, so as to weigh down said base plate of said base, with said tube of said base extending vertically upwardly through said hollow core of said cinder block of said base, against said inside corner of said cinder block of said base so as to prevent said cinder block of said base from moving out of position.

8. The device of claim 7, wherein said upright portion comprises a base tube.

9. The device of claim 8, wherein said base tube of said upright portion is replaceably received in said first cup of said base; and wherein said base tube of said upright portion extends vertically upwardly from said first cup of said base to a coupling.

10. The device of claim 9, wherein said base tube of said upright portion is parallel to said tube of said base.

11. The device of claim 10, wherein said coupling of said upright portion comprises a pair of anchoring bolts; and wherein said pair of anchoring bolts of said coupling of said upright portion thread laterally into said coupling of said upright portion.

12. The device of claim 11, wherein said upright portion comprises a variety of different sized tubes.

13. The device of claim 12, wherein at least one of said variety of different sized tubes of said upright portion is collinearly connected to said coupling of said upright portion for adjusting said device to different heights of golfers, and when more than one of said variety of different sized tubes of said upright portion are used, additional couplings connect said more than one of said variety of different sized tubes of said upright portion to each other.

14. The device of claim 13, wherein said upright portion comprises a connector.

15. The device of claim 14, wherein said connector of said upright portion connects said base tube of said upright portion to said tube of said base to maintain parallelism and prevent inadvertent removal of said cinder block of said base.

16. The device of claim 15, wherein said lateral portion comprises a confining member.

17. The device of claim 16, wherein said confining member of said lateral portion extends generally horizontally outwardly from said upright portion; and wherein said confining member of said lateral portion is generally C-shaped for allowing the golfer to enter therein and be partially encircled thereby for training the muscles of the golfer to remember how to properly swing the golf club through the set-up position, the turning position without swaying to hit the golf ball, and the follow-through position.

18. The device of claim 17, wherein said lateral portion comprises a neck.

19. The device of claim 18, wherein said neck of said lateral portion extends horizontally outwardly from said confining member of said lateral portion, towards said upright portion.

20. The device of claim 19, wherein said lateral portion comprises an extension of a highest one of said variety of different sized tubes of said upright portion bent normally thereto so as to extend horizontally from said highest one of said variety of different sized tubes of said upright portion, and be collinear with said neck of said lateral portion.

21. The device of claim 20, wherein said extension of said highest one of said variety of different sized tubes of said upright portion is attached to said neck of said lateral portion by another coupling.

22. The device of claim 1, wherein said base is wheel-like, and as such, has:

a) a hub;

b) a rim; and c) spokes;

wherein said spokes of said base extend radially outwardly from, and connect, said rim of said base to said hub of said base; and wherein said base is weighted so as to support said upright portion.

23. The device of claim 22, wherein said hub of said base is a cup.

24. The device of claim 23, wherein said cup of said hub of said base replaceably receives a base tube of said upright portion so as to allow said base tube of said upright portion to extend vertically upwardly therefrom.

25. The device of claim 24, wherein said base comprises an anchoring bolt.

26. The device of claim 25, wherein said anchoring bolt of said base threads laterally into said cup of said hub of said base.

27. The device of claim 1, wherein said base comprises a hollow disc.

28. The device of claim 27, wherein said hollow disc of said base is filled with a weighted material so as to support said upright portion.

29. The device of claim 28, wherein said weighted material of said hollow disc of said base is selected from the group consisting of sand and water.

30. The device of claim 29, wherein said base comprises a cup.

31. The device of claim 30, wherein said cup of said base is centrally disposed on said hollow disc of said base; and wherein said cup of said base replaceably receives said base tube of said upright portion so as to allow said base tube of said upright portion to extend vertically upwardly therefrom.

32. The device of claim 31, wherein said base comprises an anchoring bolt.

33. The device of claim 32, wherein said anchoring bolt of said base threads laterally into said cup of said base.

34. The device of claim 33, wherein said base comprises a filler neck;

wherein said filler neck of said base communicates with said hollow disc of said base; and wherein said filler neck of said base allows said hollow disc of said base to be filled with said weighted material of said hollow disc of said base.

35. The device of claim 34, wherein said base comprises a cap.

36. The device of claim 35, wherein said cap of said base selectively closes said filler neck of said base so as to prevent said weighted material of said hollow disc of said base from exiting said hollow disc of said base inadvertently.

* * * * *